US005186496A

United States Patent [19]

Seki

[11] Patent Number: 5,186,496

[45] Date of Patent: Feb. 16, 1993

[54] DISPLAY BINDER WITH REMOVABLE STABILIZED PAGES

[75] Inventor: Katsumichi Seki, Wilsonville, Oreg.

[73] Assignee: Kambara USA, Wilsonville, Oreg.

[21] Appl. No.: 728,980

[22] Filed: Jul. 12, 1991

[51] Int. Cl.[5] ..... B42D 3/00

[52] U.S. Cl. ..... 281/46; 281/211; 281/38; 281/151; 281/22; 402/79; 40/357

[58] Field of Search ..... 281/45, 46, 48, 49, 281/21.1, 38, 15.1, 22; 462/71; 402/73, 79; 40/357, 530, 533, 535, 388, 390, 394, 395

[56] References Cited

U.S. PATENT DOCUMENTS

| | | | |
|---|---|---|---|
| 1,132,231 | 3/1915 | Turner | 281/48 |
| 3,469,333 | 11/1966 | Roberts | 40/104.17 |
| 4,294,029 | 10/1981 | Holson | 40/388 |
| 4,426,007 | 1/1984 | Beleckis et al. | 281/46 X |
| 4,601,489 | 7/1986 | Stancato | 281/21 |
| 4,825,573 | 5/1989 | Roberts et al. | 40/159 |
| 5,040,216 | 8/1991 | Policht | 281/46 |

OTHER PUBLICATIONS

Exhibit I (Photographs of a binding with screws in the margin).

Exhibit II (Photographs of a photographic binder in which piano wire hinges are inserted into a plurality of opposing brackets).

Exhibit III (Photographs of a photographic binder with opposing slotted brackets in which piano wire hinges are inserted.

*Primary Examiner*—Timothy V. Eley
*Assistant Examiner*—Wilmon Fridie, Jr.
*Attorney, Agent, or Firm*—Klarquist, Sparkman, Campbell, Leigh & Whinston

[57] ABSTRACT

An improved photographic album for displaying aligned planar pages includes an elongated rigid spine defining a mounting surface on which a pair of spaced retainers are mounted. Each planar page has a flexible margin which carries an elongated flat hinge having hooks at either end projecting outwardly from the flexible margin toward the retainers. Each hook engages a retainer to hold the page firmly in place yet allow the page to pivot relative to the spine to flip the pages in the album. A pair of aligned notches are present in the front lip of each retainer to facilitate insertion of the hooks into the slots. One of the notches is a rounded bearing surface against which a hook can bear to flex the hook and allow the other hook to move toward engaging the other retainer. That other retainer has a ramped notch along which the second hook can ride and against which the second hook can flex to move into engagement with the retainer. Each slot has a support floor against which the tip of the hook abuts when it is placed in the slot. The pages in this album lie flat against each other with their edges well aligned. Insertion and removal of the pages is simple and quick.

25 Claims, 4 Drawing Sheets

FIG. 5
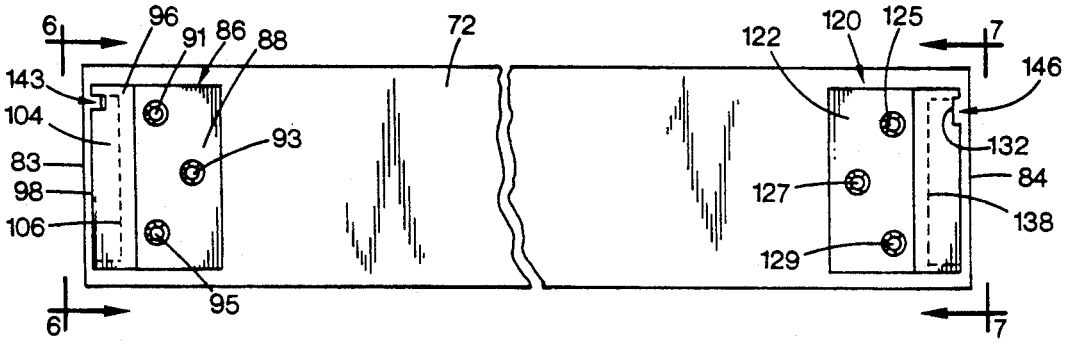
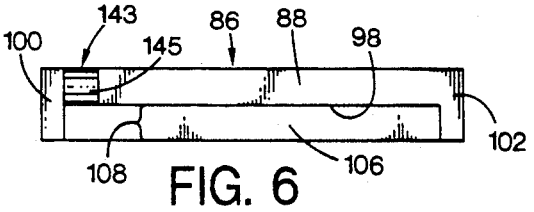
FIG. 6
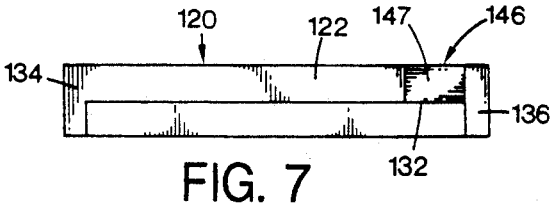
FIG. 7
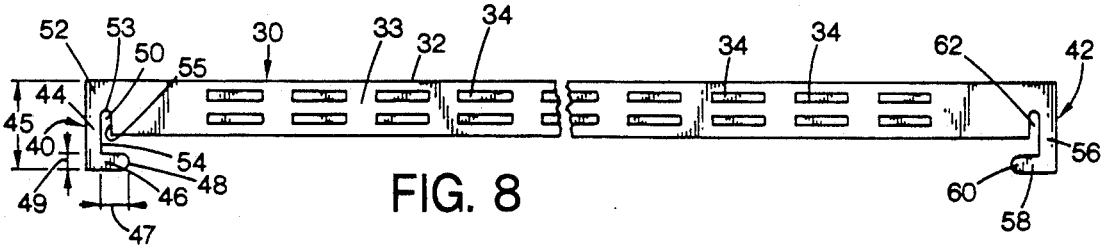
FIG. 8
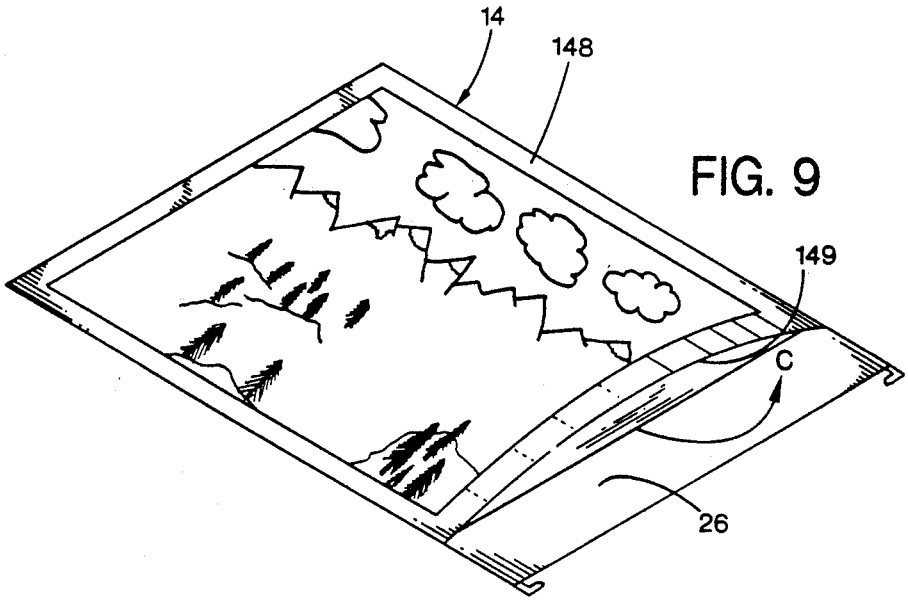
FIG. 9

DISPLAY BINDER WITH REMOVABLE STABILIZED PAGES

BACKGROUND OF THE INVENTION

This invention relates generally to the field of display books, such as photographic albums, and more particularly to an improved system for mounting display pages in a binder.

GENERAL DISCUSSION OF THE BACKGROUND

Photographs, prints, and other flat items can be conveniently and attractively displayed in bound albums. Such albums typically include display pages on which photographs or printed matter are mounted. It is convenient for the pages in such albums to be selectively removable, such that the pages can be detached from the binder and rearranged in an order preferred by a photographer or consumer. Hence, many such systems have been proposed for mounting detachable pages in display books.

One prior approach to making such an album was to fasten aligned display pages in a binding by placing a screw or other fastener through a binding margin of the aligned pages and into the binding. The screws securely and firmly lock the aligned album pages to the binding such that the edges of the pages are well aligned. It is inconvenient, however, to repeatedly screw and unscrew the fasteners that hold the pages in place. Rearranging the pages becomes burdensome and time-consuming with such a system. Hence, alternative album binders have been developed that facilitate insertion and removal of individual pages from the binding.

One such alternative approach is shown in U.S. Pat. No. 3,469,333 and U.S. Pat. No. 4,294,029 in which a flexible, thin hinge rod or piano wire extends through a binding margin of each display page. The free ends of the straight rod extend beyond the edges of the page parallel to a binding margin of the page. The free ends of the rod insert into a pair of spaced brackets mounted on the inner face of the spine of the album. Each page can be individually removed from the album by flexing the rod such that its free ends slip out of the spaced retainers. Although this system offers convenient insertion and removal of album pages, the pages are not solidly held by the binder. Hence, the pages tend to wobble and are poorly aligned with one another in the album.

Another album design is shown in U.S. Pat. No. 4,601,489 in which the album pages are interlocked in a binding by interdigitating spinal components that extend along the binding margin of the display pages and the album cover. Hinge wires are inserted through aligned rows of interdigitating spinal components to secure adjacent pages to one another, and to secure the first and last album pages to the adjacent album covers. Individual pages can be removed by withdrawing individual wire hinges from the spine and disassembling the binding. This binding system maintains the display pages in good alignment, but removal of the hinge wires is difficult and awkward. The appearance of the interlocking spinal members is, moreover, not aesthetically appealing.

It is accordingly an object of the present invention to provide an improved photographic album in which the display pages are firmly mounted in the binding and held in good alignment, and yet the pages can be conveniently inserted and removed from the album.

Yet another object of the invention is to provide such an improved album which is also aesthetically pleasing.

These and other objects of the invention will be understood more clearly by reference to the following description and drawings.

SUMMARY OF THE INVENTION

The foregoing objects are achieved in the album of the present invention by providing an album that includes an elongated, rigid spine that defines a mounting surface. A pair of spaced retainers are mounted on the surface of the spine and define a pair of co-planar slots. A hinge is carried by a binding margin of a display page, and includes a pair of flexible hooks that project from the binding edge of the page toward the spine. Each hook includes a transverse arm that is perpendicular to the binding edge of the page, and a longitudinal arm that is parallel to the binding edge. The longitudinal arms of each of the hooks fits into one of the retainer slots to firmly mount the page in the binding. The flexible hooks pivot outwardly in the plane of the page to allow them to latch into the retainer slot, and facilitate later removal of the page.

Each retainer preferably includes a pair of opposing sidewalls and a frontal lip that is parallel to the mounting plane of the spine. The lip and sidewalls define the slot in combination with the mounting plane. The retainer also includes a support surface in the retainer spaced inwardly from the edge of the lip a distance equal to the length of the longitudinal arm of the hinge. The tip of each longitudinal arm therefore abuts against the support surface to provide more stability for the display page.

Binding and unbinding the display pages is facilitated by a notch through the lip of each of the retainers. The notches on the two retainers are longitudinally aligned relative to the elongated spine. The notch in the first retainer locally reduces the height of the lip and provides a rounded bearing surface on which the first hook abuts. The notch in the second retainer defines a sloped bearing surface on which the second hook rides to ramp over the lip of the second retainer. A hook is placed in one of the notches and the page pulled away from that notch to flex the hook in the notch and allow the other hook to move through the notch into the slot of the opposing retainer. Once the opposite hook snaps into the slot of the opposing retainer, the flexible hooks return to their unflexed conditions with their tips bearing against the support surfaces inside the slot. The page can later be removed by repositioning the page with the hooks aligned with the notches and pulling the page toward one of the retainers to flex a hook against the retainer and allow the opposite hook to pop out of the slot in the opposing retainer.

BRIEF DESCRIPTION OF THE DRAWINGS

FIG. 5 is a top plan view of the spine of the album.

FIG. 6 is an enlarged view of one of the retainers taken along view lines 6—6 in FIG. 4.

FIG. 7 is an enlarged view of another retainer taken along view lines 7—7 in FIG. 4.

FIG. 8 is an enlarged, fragmentary view of the flexible hinge that is mounted along a binding margin of a display page.

FIG. 9 is a top perspective view of a display page in isolation, the border of the page having been lifted to show how photographs are inserted and withdrawn from the display page.

DETAILED DESCRIPTION OF PREFERRED EMBODIMENTS

Figure 1:
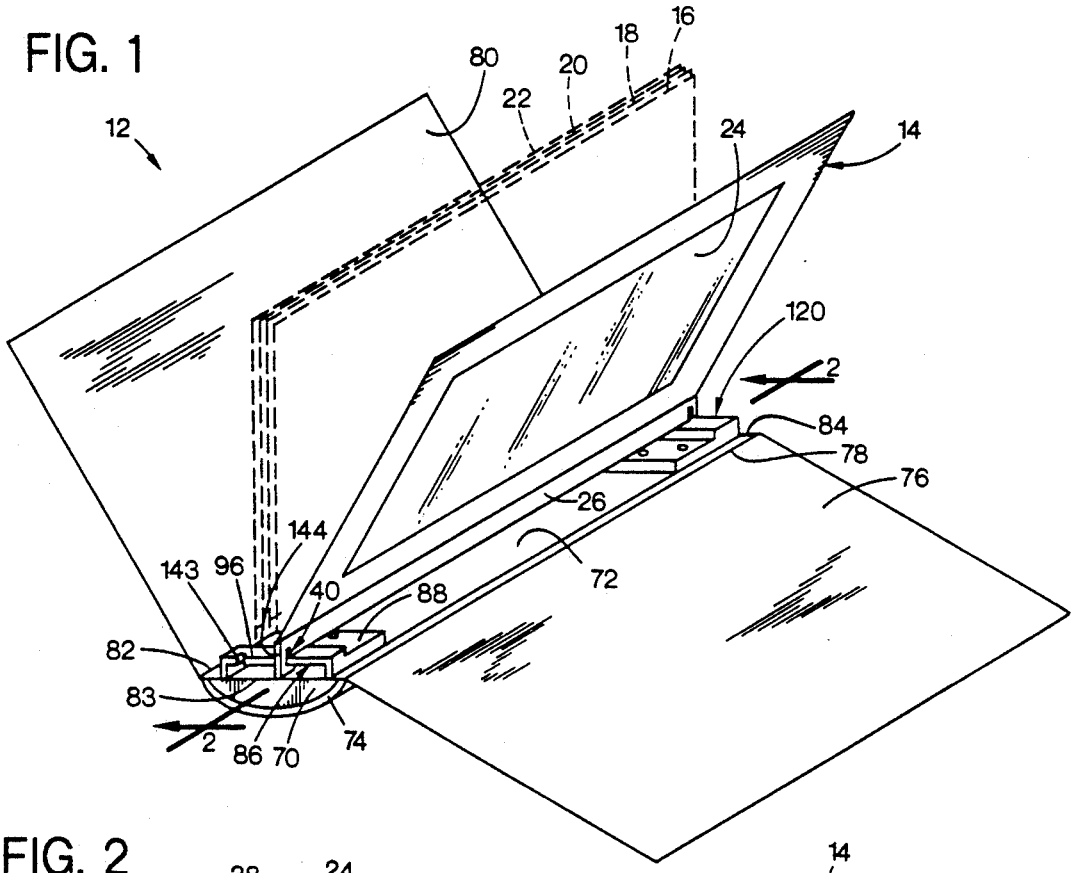
FIG. 1 is a top perspective view of the display album of the present invention, several aligned pages of the album being shown in phantom.

The present invention is an album 12 for displaying aligned planar pages 14, 16, 18, 20, 22 (FIG. 1).

Figure 2:
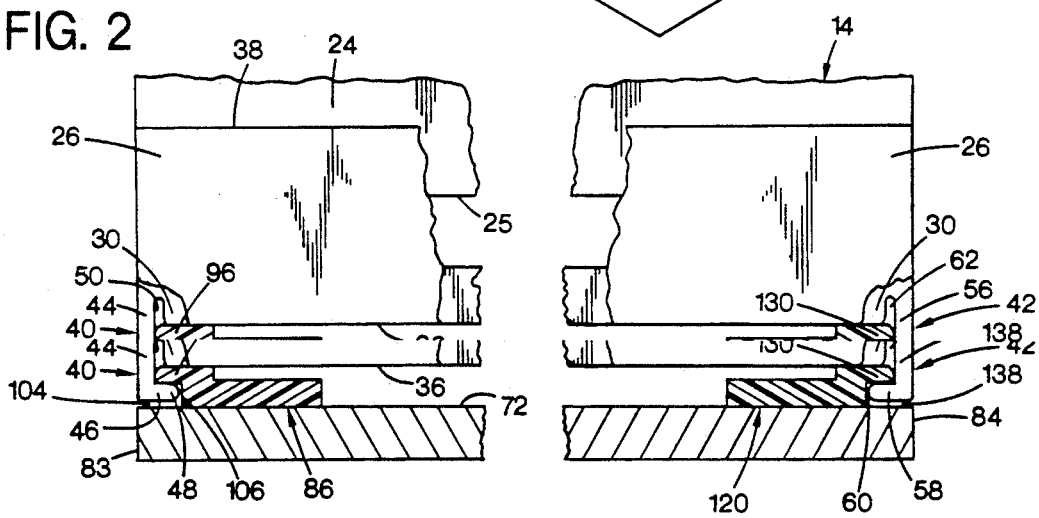
FIG. 2 is a view, partially in cross-section, taken along view lines 2—2 in FIG. 1.

Each page 14–22 includes a planar, rectangular cardboard sheet 24 that forms a display portion of the page and terminates along a longitudinal binding edge 25. A flexible binding margin 26, preferably made of a flexible tape material, extends along longitudinal edge 25 of sheet 24. An elongated, generally planar hinge 30 (FIGS. 2 and 8) is mounted within the flexible margin 26. Margin 26 is rigidified where it is reinforced at its outer edge by cardboard sheet 24 and at its inner edge by planar hinge 30. The intermediate portion of margin 26 between the sheet and hinge is, however, sufficiently flexible to allow sheet 24 to move through a wide arc relative to stationary hinge 30.

As shown in FIG. 8, hinge 30 is a flat, flexible, imperforate plastic strip 32 having a planar rear face (not shown) and a generally planar front face 33 along which extend two aligned rows of rectangular indentations 34. These indentations reduce warping of the hinge after it is taken out of the mold in which it is formed. The hinge is preferably made of a molded nylon thermoplastic resinous material. Other plastics such as PVC and ABS can be used, but have been found to be more brittle and subject to breakage when subjected to bending forces during usage. Hinge 30 is secured in flexible margin 26 by folding the flexible material over the hinge to sandwich it along an inside binding edge 36 between the layers of material, then gluing the hinge inside the fold and adhering the free edges 38 of the material to opposite faces of sheet 24.

Each hinge 30 has flat free ends that project from the edge 36 of the flexible margin 26 and form a flexible flat bottom hook 40 and flexible flat top hook 42. The front faces of hooks 40, 42 are co-planar with the front face 33 of strip 32. The rear faces (not shown) of hooks 40, 42 are similarly co-planar with the rear face of strip 32. Hook 40 is an L-shaped member that includes a transverse arm 44 extending substantially perpendicular to edge 36 of flexible margin 26, and terminating in a longitudinal arm 46 that extends perpendicular to transverse arm 44 and substantially parallel to edge 36 of the page 14. Transverse arm 44 has a length 45, while longitudinal arm 46 has a length 47 and width 49. Flattened longitudinal arm 46 terminates in a rounded tip 48 which comprises an arcuate surface extending between the planar front and rear faces of hook 40.

Figure 4:
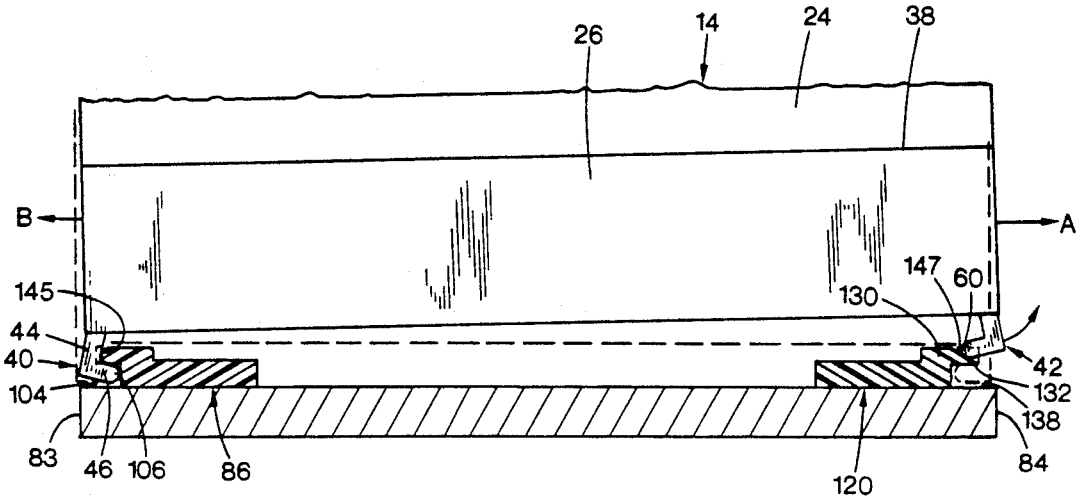
FIG. 4 is a view similar to FIG. 2 showing the position of the page and flexible hooks during insertion of the page in the album.

A slotted recess 50 extends into strip 32 parallel to transverse arm 44 to reduce the width of strip 32 to a narrow neck 52 (FIG. 8) at the origin of transverse arm 44. Slot 50 extends across about half of the width of hinge 30 and forms a rounded inner notch 53 with linear sidewalls 54, 55. The slot 50 increases the effective pivot length of arm 44 and imparts greater flexibility to hook 40 that allows arm 44 to pivot in the plane of strip 32 about an axis perpendicular to flat hinge 30 through neck 52, as shown in FIG. 4. In preferred embodiments, hook 40 pivots through a distance of about 1 mm.

Hook 42 is similar to hook 40, and includes a transverse arm 56 that is perpendicular to edges 36 of strip 32, and a longitudinal arm 58 that is perpendicular to transverse arm 56 and parallel to strip 32. Longitudinal arm 58 terminates in a rounded tip 60. A transverse slot 62 extends partially across the width of strip 32 to enhance flexibility of hook 42 in the plane of strip 32, as shown in FIG. 4.

Album pages 14–22 (FIG. 1) are mounted in a leather covered book having a rigid elongated spine 70 that forms a flat inner mounting surface 72 and an outer arcuate leather covered face 74. A front cover flap 76 is bound to spine 70 along a book binding seam 78 at a longitudinal edge of spine 70 such that cover 76 can pivot through an arc of at least 90 degrees relative to spine 70 about an axis through seam 78. Rear cover flap 80 is similarly mounted to spine 70 along a book binding seam 82 at a longitudinal edge of spine 70 such that rear cover 80 can also pivot relative to the spine about an axis through seam 82. Free edge 83 of surface 72 defines a bottom transverse border of surface 72, while a free edge 84 defines the top transverse border of surface 72.

Figure 10:
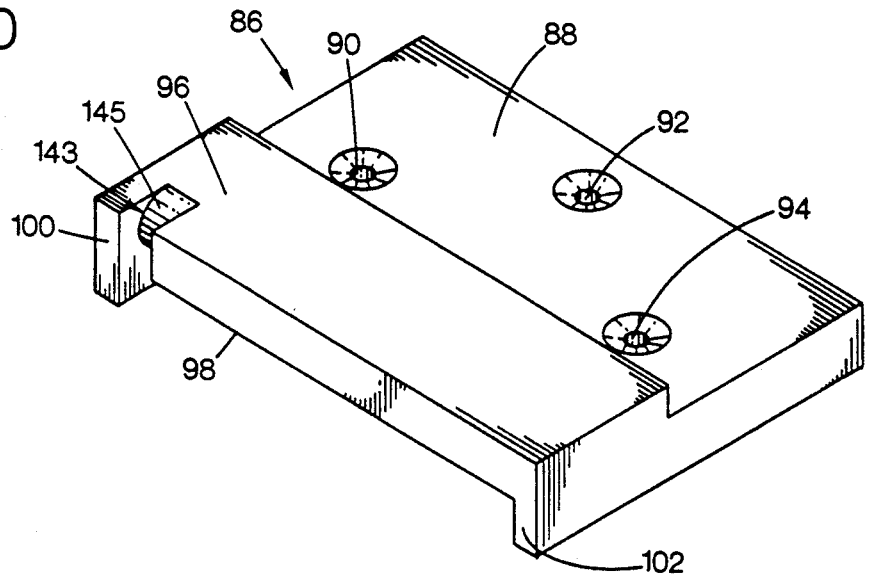
FIG. 10 is an enlarged, perspective view of the retainer shown in FIG. 6.

A first rigid retainer 86 (FIGS. 1, 2, 4–7, and 9) is mounted on surface 72 of spine 70 adjacent bottom edge 83. The first retainer includes a rigid plastic attachment plate 88 having an inner surface that fits flush against mounting surface 72. Three countersunk screw holes 90, 92, 94 (FIG. 10) extend through plate 88, and screws 91, 93, 95 (FIG. 5) are inserted through respective holes 90, 92, 94 to securely fasten retainer 86 against mounting surface 72. The bottom portion of retainer 86 is a raised lip 96 having an inner face spaced from mounting surface 72. Lip 96 has an inner edge 98 which extends parallel to bottom edge 83 of surface 72. Lip 96, in combination with sidewalls 100, 102 and mounting surface 72, forms a narrow slot 104 (FIGS. 2, 4, 5) that extends across the width of retainer 86 between surface 72 and lip 96. A support surface 106 extends perpendicularly between surface 72 and lip 96, thereby forming the inner border of slot 104. The width 108 (FIG. 6) of slot 104 is substantially the same as the width 49 of arm 46 (FIG. 8). Support surface 106 is spaced a distance below edge 98 that is substantially equal to the length 47 of arm 46 (FIG. 8) such that rounded tip 48 can bear against support surface 106 when the album is assembled as in FIG. 2.

Figure 11:
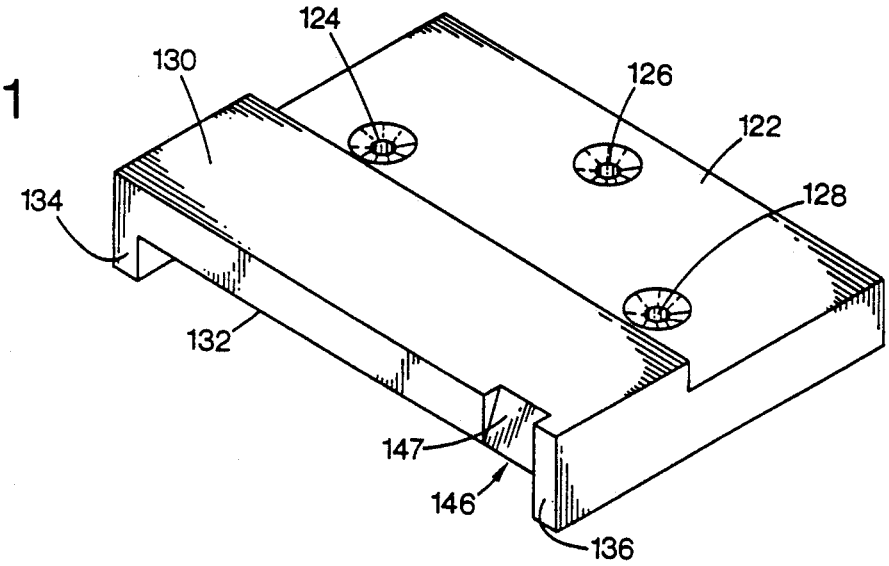
FIG. 11 is an enlarged, perspective view of the retainer shown in FIG. 7.

A second rigid retainer 120 (FIGS. 1, 2, 4, 5, 7 and 11) is mounted on surface 72 adjacent top edge 84 of spine 70. This second retainer includes a rigid plastic attachment plate 122 having an inner surface that fits flush against mounting surface 72. Three countersunk screw holes 124, 126, 128 (FIG. 11) extend through plate 122, and screws 125, 127, 129 (FIG. 5) are inserted through respective holes 124, 126, 128 to securely fasten retainer 120 against mounting surface 72. The top portion of retainer 120 is a raised lip 130 (FIG. 11) having an inner face spaced from mounting surface 72. Lip 130 has an inner edge 132 which extends parallel to top edge 84 of Surface 72.

Lip 130, in combination with sidewalls 134, 136 and mounting surface 72, forms a narrow slot 138 (FIGS. 2 and 4) that extends across the width of retainer 120 above surface 72. A support surface 140 extends perpendicularly between surface 72 and lip 130, thereby forming the inner border of slot 138. The width of slot 138 between surface 72 and the inside surface of lip 130 is substantially the same as the width of arm 58. Support surface 140 is spaced a distance below edge 132 that is substantially equal to the length of arm 58 such that rounded tip 60 can bear against support surface 140 when the album is assembled.

Bottom and top retainer slots 104, 138 open in opposite directions in a plane parallel to the mounting surface 72. Bottom slot 104 opens downwardly adjacent bottom edge 83 while top slot 138 faces upwardly adjacent top edge 84 of surface 72. The two retainers also differ in the configuration of their lips 96, 130. Bottom lip 96 has a notch 143 that is adjacent sidewall 100 (FIG. 6) and extends away from sidewall 100 a distance only slightly greater than the thickness of face 144 (FIG. 1) of hook 40. A bearing surface 145 in notch 143 is a curved surface having a semi-cylindrical cross-section that does not reach as high as edge 98 of lip 96. Hence, notch 143 locally reduces the height of lip 96 and provides an arcuate bearing surface on which bottom hook 40 abuts as the album page is inserted or withdrawn from the album.

The lip 130 in the top retainer 120 has a notch 146 that is adjacent sidewall 136 and extends away from sidewall 136 a distance only slightly greater than the thickness of hook 42. Notches 143, 146 are linearly aligned relative to the longitudinal axis of the spine 70. An anterior inclined bearing surface 147 provides a ramp up the front of lip 130 and terminates at sharp edge 132 that is co-linear with the sharp edge 132 that runs the length of lip 130. Hence, notch 146 provides an inclined bearing surface on which top hook 42 can ride to pivot hook 42 as the album page is inserted or withdrawn from the album. Sharp edge 132 acts as a retention member to maintain hook 42 in slot 138 once hook 42 surmounts edge 132 and snaps into slot 138.

In operation, album page 14 can be mounted in album 12 in several different ways. Generally, one of the hooks 40 or 42 is hooked into one of the slots 104 or 138. The engaged hook is then flexed to move the opposing hook over the lip of the opposite retainer and into the retainer slot. The opposing hook also flexes to move over the lip into the retainer.

Figure 13:
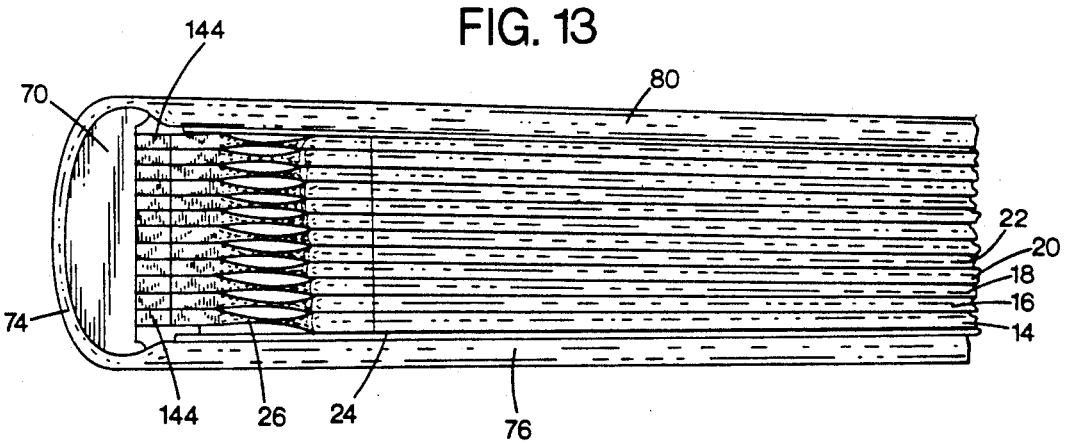
FIG. 13 is a fragmentary end view of the display album showing the aligned pages hooked to the spine of the binder.

One method of inserting the pages in the binder is shown in FIG. 4. Page 14 is aligned with edge 36 extending between notches 143, 146 with bottom hook 40 adjacent notch 143 and top hook 42 adjacent notch 146. Hook 40 is placed into notch 143 with arm 44 resting on bearing surface 145 and arm 46 projecting down toward surface 106. Album page 14 is then tilted upward from the phantom position shown in FIG. 4 to the position shown in solid lines. The tip 60 of opposing hook 42 is then abutted against ramp 147 in lip 122. An operator then grasps page 14 and pulls it toward top retainer 120 in the direction of the arrow A in FIG. 4. As the page 14 is pulled toward retainer 120, hooks 40, 42 simultaneously pivot. Lower hook 40 pivots as it impinges against curved bearing surface 145 of notch 143. Tip 60 pivots as it is pushed against ramp 147 of notch 146 until tip 60 surmounts edge 132 of the notch and snaps into slot 138. Both hooks 40, 42 then relax, page 14 moves into the position shown in phantom in FIG. 4, and the hooks are moved longitudinally in their respective slots 104, 138 away from notches 143, 146 to move page 14 away from the notches. The same process is then repeated sequentially for pages 16, 18, 20, 22 and so on until the available space in slots 104, 138 is occupied by the hooks. When the slots are filled, the album pages and planar hinges will lie parallel to one another, as shown in FIG. 13. The stacked arrangement of flat hinges 30 helps maintain the alignment of the pages.

When removal of the album pages is desired, the foregoing process is reversed. The page to be removed is aligned with the aligned notches 143, 146 and the page is pulled in the direction of the arrow A in FIG. 4. The tension exerted on the page is transmitted through the hinge 30 to bottom hook 40, which impinges the hook 40 against bearing surface 145 and pivots the hook as shown in FIG. 4. As hook 40 pivots, album page 14 is allowed to move in the direction of the arrow A, and the page can be tilted as shown in FIG. 4 to bring hook 42 into contact with edge 132. Hook 42 then pivots and snaps over edge 132, rides down inclined ramp 147, and releases the tension on hinge 30. Hook 40 then relaxes and is removed from bottom retainer 86 by moving the album page toward bottom retainer 86.

The order of hook insertion can be reversed by first inserting hook 42 into slot 138 behind lip 132. Album page 14 is then tilted upward and pulled in the direction of arrow B toward retainer 86. Tip 46 of hook 40 impinges the arcuate bearing surfaced 145 in notch 143 and pivots outwardly and over surface 145. As tip 45 surmounts bearing surface 145, it relaxes and snaps down into slot 104. The page can be removed by reversing this process, or using the removal process described in the preceding paragraph.

The album of the present invention is preferably used to display photographs. The photographs are retained against the display portion 24 by a rectangular cardboard border 148 that is secured to three edges of the sheet. A third edge 149 of the border is not secured to the page, but instead can be lifted away from the page to insert or withdraw a photograph along the path of arrow C.

As used in this specification, the term "hook" does not include a linear member, but instead contemplates the presence of a curved or bent portion in the relaxed state.

ALTERNATIVE EMBODIMENTS

Figure 3:
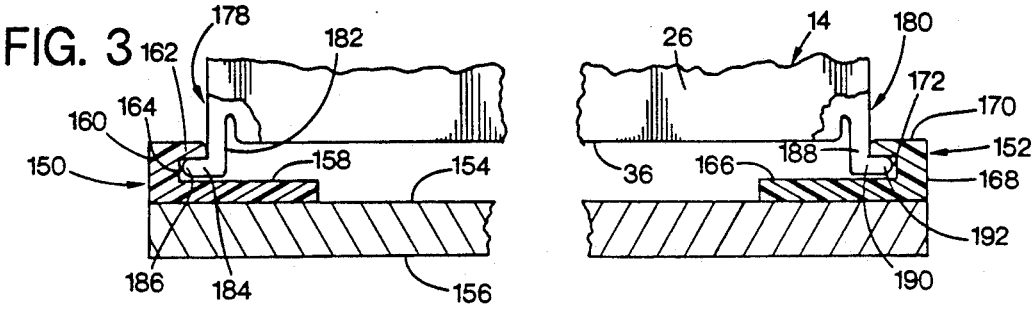
FIG. 3 is a view similar to FIG. 2 showing an alternative embodiment of the invention.

An alternative embodiment of the retainers and hooks is shown in FIG. 3 where bottom and top retainers 150, 152 are positioned at opposing transverse edges of mounting surface 154 of spine 156. Bottom retainer 150 includes a mounting plate 158 that is secured tightly against surface 154, an outwardly extending flange 160 that projects away from surface 154, and an upwardly protruding lip 162. The lip 162 defines an elongated slot 164 in cooperation with flange 160 and mounting plate 158. Top retainer 152 similarly includes a mounting plate 166, outwardly extending flange 168 and downwardly extending lip 170 that defines a slot 172 in cooperation with mounting plate 166 and flange 168. The slots 164, 172 are co-planar parallel to surface 154 and open toward each other such that the slots oppose one another.

A pair of hooks 178, 180 project outwardly from the edge of flexible margin 26 toward retainers 150, 152. Hook 178 includes a transverse arm 182 that is perpendicular to the edge 36 of margin 26, and a longitudinal arm 184 that is perpendicular to arm 182 and substantially parallel to the edge 36 of flexible margin 26. Arm 184 terminates in a rounded tip 186. Hook 180 similarly includes a transverse arm 188, longitudinal arm 190 and terminal tip 192. Longitudinal arms 184, 190 point away from one another in opposite directions such that the tips can both be inserted into inwardly facing, opposing complementary slots 164, 172. The longitudinal arms 184, 190 are free to slide in slots 164, 172 in a sliding plane that extends through both slots substantially parallel to surface 154. As the arms slide, the hinge and attached binding margin 26 are maintained perpendicular to surface 72 and move transverse to mounting surface 72 as hooks 178, 180 slide in slots 164, 172.

Album page 14 may be mounted in retainers 150, 152 in one of several methods, for example, by inserting arm 184 of hook 178 into slot 172 with arm 182 resting on the edge of a notch (not shown) that is similar to notch 143 in retainer 86 (FIG. 6). The operator then moves album page 14 toward retainer 150 to pivot flexible hook 178 inwardly as the hook abuts against lip 162. Rounded tip 192 of top hook 180 then slides down a ramped notch on the inside surface of lip 170, which bends flexible hook 180 inwardly. As tip 192 surmounts the sharp edge of the ramped notch, tip 192 pops into slot 172, and both hooks 178, 180 then relax. An operator then slides album page 14 away from the notches by sliding hooks 178, 180 in slots 164, 172. Subsequent pages are then placed in retainers 150, 152 in a similar manner until the binder is filled with the number of desired pages.

Figure 12:
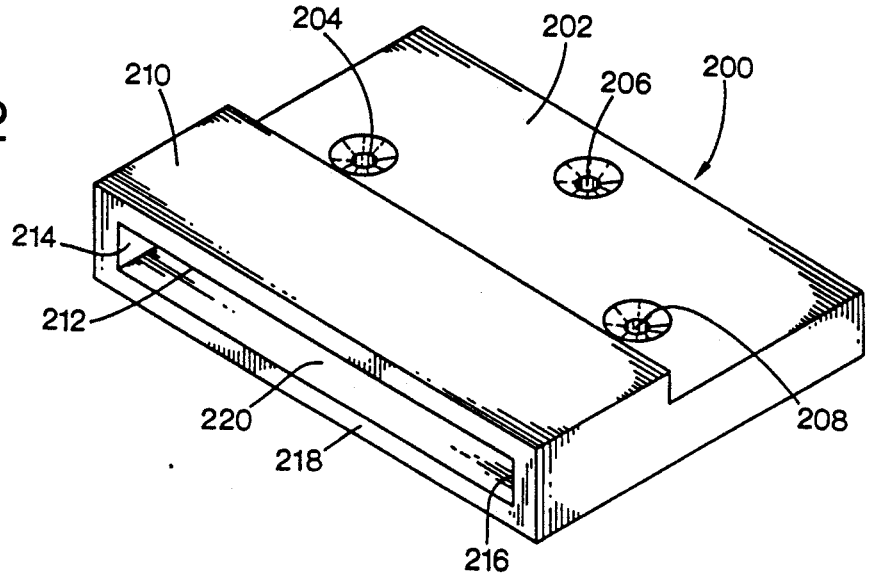
FIG. 12 is a perspective view of an alternative embodiment of the retainer.

Yet another embodiment of the invention is shown in FIG. 12, which depicts a retainer 200 that can replace either or both of retainers 86, 120. This retainer includes a rigid plastic plate 202 through which extend three countersunk screw holes 204, 206, 208. Screws are placed through holes 204, 206, 208 to fix plate 202 against mounting surface 72. A raised lip 210 is provided along one edge of plate 202, and has an inner face 212 that, in combination with sidewalls 214, 216 and a backwall 218, forms a narrow slot 220 that extends across the width of retainer 200. No notches are provided in front lip 210. Hence, hooks, such as 40 or 42, have to be flexed to a greater extent than with retainers 86, 120 to position the hooks in slots 220.

Having illustrated and described the principles of the invention in several preferred embodiments, it should be apparent to those skilled in the art that the invention can be modified in arrangement and detail without departing from such principles. We claim all modifications coming within the spirit and scope of the following claims.

I claim:

1. An album for displaying aligned planar pages, comprising:

an elongated rigid spine;

a first retainer mounted on the spine and defining a first slot;

a second retainer mounted on the spine and defining a second slot, the first and second slots being substantially coplanar; and a hinge comprising first and second flexible hooks projecting from an edge of a page toward the spine, each hook comprising a first arm and a second arm, the second arm on the first hook fitting into the first slot and the second arm on the second hook fitting into the second slot, with the second arm of the first hook and the second arm of the second hook pointing toward each other.

2. The album of claim 1 wherein the first and second retainers each comprises a frontal lip in opposed spaced relationship to the spine and which partially defines the slot.

3. An album for displaying aligned planar pages, comprising:

an elongated rigid spine;

a first retainer mounted on the spine and defining a first slot;

a second retainer mounted on the spine and defining a second slot, the first and second slots being substantially coplanar;

a hinge comprising first and second flexible hooks projecting from an edge of a page toward the spine, each hook comprising a first arm and a second arm, the second arm on the first hook fitting into the first slot and the second arm on the second hook fitting into the second slot;

wherein the first and second retainers each comprises a frontal lip in opposed relationship to the spine and which at least partially defines the slot, and wherein the first hook is flexible and the first retainer includes a notch in the lip of the first retainer that locally reduces the height of the lip and provides a bearing surface.

4. The album of claim 3 further comprising a notch in the lip of the second retainer.

5. The album of claim 4 wherein the second hook is flexible and the notch in the lip of the second retainer further includes a sloped bearing surface.

6. The album of claim 1 wherein the hinge further comprises a generally planar member mounted in the page along the edge thereof.

7. The album of claim 6 wherein the page comprises a display portion and a flexible margin that is more flexible than the display portion, and the edge extends along the flexible margin.

8. The album of claim 7 wherein the display portion of the page comprises a photograph displayer.

9. An album for displaying aligned planar pages, comprising:

an elongated rigid spine;

a first retainer mounted on the spine and defining a first slot;

a second retainer mounted on the spine and defining a second slot, the first and second slots being substantially coplanar;

a hinge comprising first and second flexible hooks projecting from an edge of a page toward the spine, each hook comprising a first arm and a second arm, the second arm on the first hook fitting into the first slot and the second arm on the second hook fitting into the second slot, wherein the first arm of each hook is substantially perpendicular to the edge, and the second arm is substantially parallel to the edge.

10. The album of claim 9 wherein the spine defines a mounting plane against which the first and second retainers are mounted, each retainer comprising a frontal lip extending parallel to the mounting plane and which partially defines the slot between the lip and mounting plane, and a support surface in the retainer spaced from the lip a distance substantially equal to the length of the second arm.

11. The album of claim 10 further comprising a first notch through the lip of the first retainer and a second notch through the lip of the second retainer, the first and second notches being longitudinally aligned relative to the elongated spine, the notch in the first retainer locally reducing the height of the lip and providing a rounded bearing surface against which the first hook can flex during page insertion, the notch in the first retainer including a sloped bearing surface.

12. The album of claim 3 wherein the spine defines a mounting plane against which the first and second retainers are mounted, and the first and second slots open in opposite directions in a plane parallel to the mounting plane, and the second arms of the hooks point toward each other.

13. The album of claim 3 wherein the spine defines a mounting plane against which the first and second retainers are mounted, and the first and second slots open toward each other in a plane parallel to the mounting plane, and the second arms of the hooks point away from each other.

14. The album of claim 3 wherein the hinge is a nylon plastic hinge.

15. An album for displaying aligned planar pages, comprising:

a planar page including a flexible binding margin and a display portion;

a rigid elongated spine that defines a mounting surface;

a first rigid retainer mounted on the mounting surface of the spine, the first retainer comprising opposing sidewalls, a frontal lip substantially parallel to the mounting surface, and a support surface spaced inwardly from an outer edge of the lip, wherein the sidewalls, lip, and support surface of the first retainer define a first slot;

a second rigid retainer mounted on the mounting surface of the spine, the second retainer comprising opposing sidewalls, a frontal lip substantially parallel to the mounting surface, and a support surface spaced inwardly from an outer edge of the lip, wherein the sidewalls, lip, and support surface of the second retainer define a second slot, the first and second slots opening in opposite directions in a plane parallel to the mounting surface;

an elongate, flat hinge mounted in the flexible margin and lying the plane of the page, the hinge having free ends projecting perpendicularly from an edge of the flexible margin toward the mounting surface and forming first and second flexible hooks, each hook comprising a transverse arm substantially perpendicular to the edge of the page, and a longitudinal arm substantially parallel to the edge of the page, the longitudinal arm on the first hook fitting into the first slot and the longitudinal arm on the second hook fitting into the second slot, wherein the longitudinal arms extend toward each other a sufficient distance that a tip of the longitudinal arm of the first hook abuts against the support surface of the first retainer, and a tip of the longitudinal arm of the second hook abuts against the support surface of the second retainer; and a first notch through the lip of the first retainer and a second notch through the lip of the second retainer, the first and second notches being longitudinally aligned relative to the elongated spine, the notch in the second retainer locally reducing the height of the lip and providing a curved bearing surface against which the first hook can flex, the notch in the second retainer including a sloped bearing surface that guides the second hook into the lip of the second retainer as the first hook flexes.

16. A device for displaying pages, comprising;

a rigid spine;

a planar page for insertion in the device, each page having a flexible margin and flexible hook means for retaining the page in the device;

first and second spaced retainers on the rigid spine that engage the hook means to retain the page; and first hook flexing means on the first retainer and second hook flexing means on the second retainer for flexing the hooks over a surface of the retainer to insert them into the retainer, wherein the first retainer defines a first slot and the second retainer defines a second slot, and the hook flexing means comprises a notch in the first retainer along a front edge of the first slot, and a notch in the second retainer along a front edge of the second slot.

17. The device of claim 16 wherein one of the notches is a ramp leading to a sharp edge.

18. The device of claim 16 wherein one of the notches is an indentation that lowers the front edge and defines a bearing surface against which one of the hooks can flex during insertion or removal of the page.

19. A method of arranging pages in a display, comprising:

providing a rigid spine and planar pages for insertion in the display, each page having a binding edge and first and second flexible hooks for retaining the pages in the display;

providing first and second spaced retainers that are engageable with the hooks, the first retainer having a notch; and inserting a first hook in the notch of the first retainer and flexing the first hook to move the second hook into engagement with the second retainer.

20. The method of claim 19 further comprising the step of flexing the second hook while flexing the first hook.

21. The method of claim 19 further comprising the step of providing a ramp in the second retainer along which the second hook rides and against which it flexes as the first hook is flexing.

22. The method of claim 19 further comprising the step of removing the page by flexing the first hook to move the second hook out of engagement with the second retainer.

23. A page display, comprising:

first and second spaced retainers;

a page for insertion in the display, the page having first and second flexible hooks that have tips which point towards each other, the hooks being engageable with the retainers for retaining the page in the display; and a notch in the first retainer that engages the first hook and flexes it when the hook is impinged against the notch to move the second hook toward engagement with the second retainer.

24. The display of claim 23 further comprising a ramp on the second retainer against which the second hook impinges during insertion of the page in the display to flex the second hook as the second hook moves toward engagement with the second retainer.

25. The display of claim 23 wherein all the surface of the first and second flexible hooks are flat.

* * * * *